US008827741B2

(12) United States Patent
Johnson et al.

(10) Patent No.: US 8,827,741 B2
(45) Date of Patent: Sep. 9, 2014

(54) HOUSING INSERT CONTACT PROTECTION

(75) Inventors: Lewis R. Johnson, Dover, PA (US); Steven E. Minich, York, PA (US); Derek L. Brickner, Etters, PA (US); Scott Kleinle, Chester Springs, PA (US)

(73) Assignee: FCI Americas Technology LLC, Carson City, NV (US)

( * ) Notice: Subject to any disclaimer, the term of this patent is extended or adjusted under 35 U.S.C. 154(b) by 194 days.

(21) Appl. No.: 13/437,360

(22) Filed: Apr. 2, 2012

(65) Prior Publication Data

US 2012/0258626 A1 Oct. 11, 2012

Related U.S. Application Data

(60) Provisional application No. 61/516,794, filed on Apr. 8, 2011.

(51) Int. Cl.

| | |
|---|---|
| ***H01R 13/60*** | (2006.01) |
| ***H01R 13/518*** | (2006.01) |
| ***H01R 12/16*** | (2006.01) |
| ***H01R 24/84*** | (2011.01) |
| *H01R 12/71* | (2011.01) |

(52) U.S. Cl.

CPC ..... *H01R 13/518* (2013.01); *H01R 23/7073* (2013.01); *H01R 12/716* (2013.01); *H01R 24/84* (2013.01)

USPC ..... 439/541.5; 439/682

(58) Field of Classification Search

CPC ..... H01R 23/7073; H01R 23/6873; H01R 23/025; H01R 23/725; H01R 23/02; H01R 13/112; H01R 13/11

USPC ..... 439/541.5, 680, 682

See application file for complete search history.

(56) References Cited

U.S. PATENT DOCUMENTS

| | | | | |
|---|---|---|---|---|
| 3,789,348 | A | 1/1974 | Lenaerts et al. | 339/198 R |
| 4,884,975 | A * | 12/1989 | Pelzl et al. | 439/78 |
| 4,975,062 | A | 12/1990 | Evans et al. | 439/13 |
| 5,071,374 | A | 12/1991 | Plocek et al. | 439/752 |
| 5,387,132 | A * | 2/1995 | Sarver et al. | 439/633 |
| 7,140,925 | B2 | 11/2006 | Allison et al. | 439/680 |
| 7,785,152 | B2 | 8/2010 | Yi et al. | 439/660 |
| 8,545,275 | B2 * | 10/2013 | Wang et al. | 439/693 |
| 2003/0162441 | A1 | 8/2003 | Nelson et al. | 439/608 |
| 2005/0032429 | A1 | 2/2005 | Hull et al. | 439/608 |
| 2009/0117786 | A1 * | 5/2009 | Westkamp et al. | 439/676 |
| 2010/0055988 | A1 | 3/2010 | Shuey et al. | 439/660 |

FOREIGN PATENT DOCUMENTS

| | | |
|---|---|---|
| JP | 2004296197 | 10/2004 |

* cited by examiner

*Primary Examiner* — Khiem Nguyen
(74) *Attorney, Agent, or Firm* — Harrington & Smith

(57) ABSTRACT

An electrical connector housing including a main housing member and at least one protective wafer. The main housing member has a contact locating area. Opposite sides of the contact locating area include slots for receiving opposite end portions of insertable wafers. The at least one protective wafer is configured to be located in the contact locating area and includes opposite end portions adapted to be matingly slid into a pair of the slots. The protective wafer has a top side configured to project above top ends of contacts located in the contact locating area. The protective wafer and the main housing member are sized and shaped to combine to help prevent a user's finger from contacting the top ends of the contacts located in the contact locating area.

21 Claims, 10 Drawing Sheets

HOUSING INSERT CONTACT PROTECTION

CROSS-REFERENCE TO RELATED APPLICATION

This application claims the benefit under 35 USC 119(e) of U.S. Provisional Patent Application No. 61/516,794, filed Apr. 8, 2011, which is hereby incorporated by reference in its entirety.

BACKGROUND

1. Technical Field

The exemplary and non-limiting embodiments of the invention relate generally to an electrical connector and, more particularly, to a housing of an electrical connector.

2. Brief Description of Prior Developments

U.S. patent publication No. 2010/0055988 A1 discloses mating connector housings with sidewall recesses for orientation mating. U.S. Pat. No. 6,869,292 B2 discloses an electrical connector housing with key projections at corners and a mating electrical connector housing with key recesses at corners.

SUMMARY

The following summary is merely intended to be exemplary. The summary is not intended to limit the scope of the claims.

In accordance with one aspect, an electrical connector housing is provided including a main housing member and at least one protective wafer. The main housing member has a contact locating area. Opposite sides of the contact locating area include slots for receiving opposite end portions of insertable wafers. The at least one protective wafer is configured to be located in the contact locating area and includes opposite end portions adapted to be matingly slid into a pair of the slots. The protective wafer has a top side configured to project above top ends of contacts located in the contact locating area. The protective wafer and the main housing member are sized and shaped to combine to help prevent a user's finger from contacting the top ends of the contacts located in the contact locating area.

In accordance with another aspect, an electrical connector is provided comprising a plurality of Insert Molded Leadframe Assemblies (IMLAs); and a housing having the IMLAs connected thereto. The housing comprises a main housing member and at least one protective wafer connected to the main housing member. The main housing member comprises a contact locating area having IMLA mounting slots on opposite sides of the contact locating area. The IMLAs each have opposite ends located in pairs of the IMLA mounting slots. The protective wafer comprises opposite end portions matingly slid into a pair of the slots. The protective wafer has a top side projecting above top ends of contacts of the IMLAs. The top side and the main housing are sized and shaped to combine to help prevent a user's finger from contacting the top ends of the contacts.

In accordance with another aspect, a method comprises providing a main housing member, where the main housing member comprises a contact locating area having IMLA mounting slots on opposite sides of the contact locating area; and inserting at least one protective wafer into the main housing member, where the protective wafer comprises opposite end portions matingly slid into a pair of the IMLA mounting slots, where the protective wafer has a top side adapted to project above top ends of contacts located in the contact locating area, where the top side is sized and shaped to combine with the main housing to help prevent a user's finger from contacting the top ends of the contacts located in the contact locating area.

In accordance with another aspect, an electrical connector is provided comprising a plurality of Insert Molded Leadframe Assemblies (IMLAs); and a housing having the IMLAs connected thereto. The housing comprises a contact locating area having IMLA mounting slots on opposite sides of the contact locating area. The IMLAs each have opposite ends located in pairs of the IMLA mounting slots. The housing comprises at least one top outer wall forming a raised perimeter around the contact locating area and at least one interior wall between opposite sections of the raised perimeter forming spaced sections of the IMLAs. The at least one interior wall has a top side projecting above top ends of contacts of the IMLAs. The top side of the interior wall comprises a general wedge shape. The top side and the raised perimeter are sized and shaped to combine to help prevent a user's finger from contacting the top ends of the contacts.

BRIEF DESCRIPTION OF THE DRAWINGS

The foregoing aspects and other features are explained in the following description, taken in connection with the accompanying drawings, wherein.

DETAILED DESCRIPTION OF EMBODIMENTS

Figure 1:
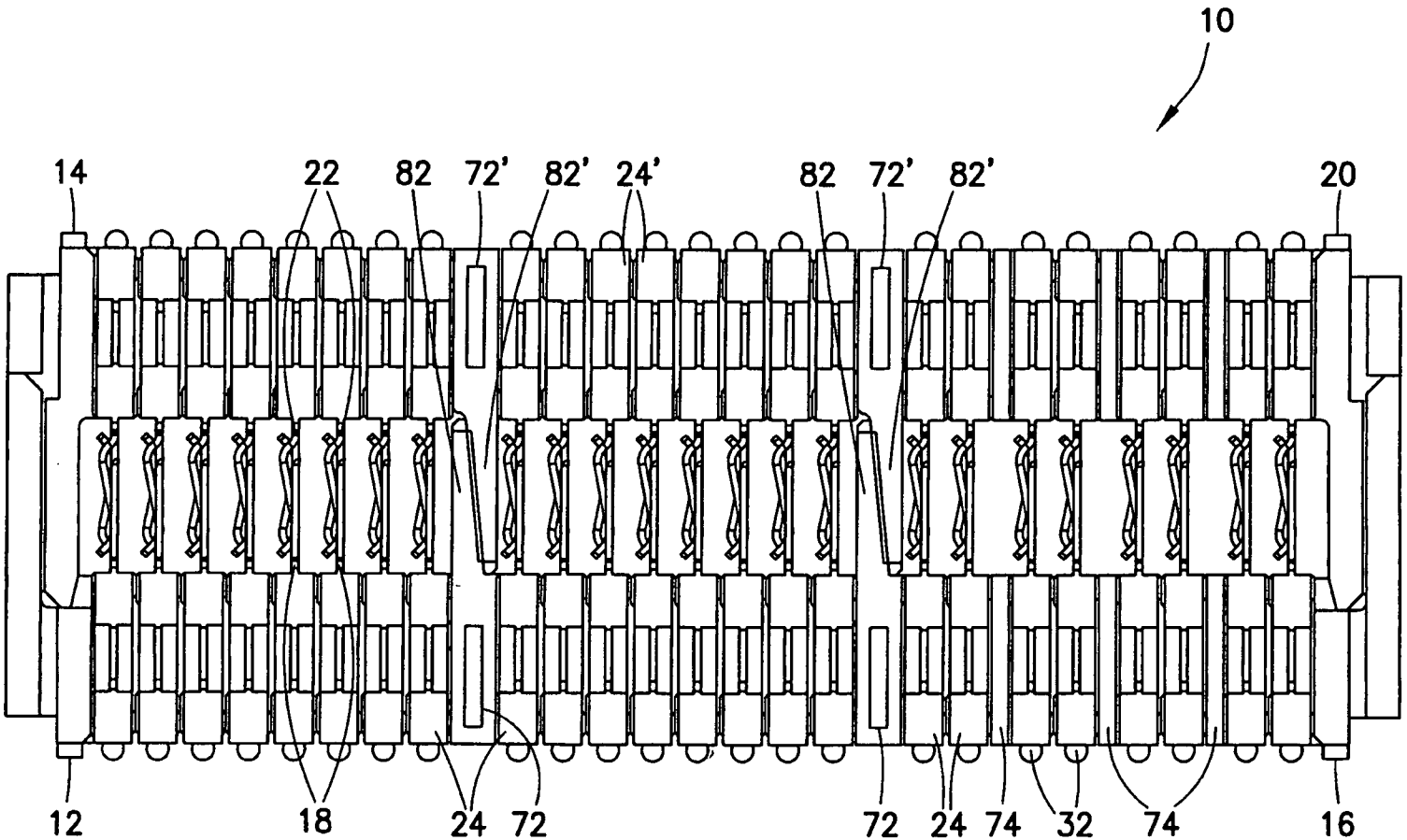
FIG. 1 is a cross sectional view of an electrical connector assembly 10 incorporating features of an example embodiment.

Referring to FIG. 1, there is shown a cross sectional view of an electrical connector assembly 10 incorporating features of an example embodiment. Although the features will be described with reference to the example embodiments shown in the drawings, it should be understood that features can be embodied in many alternate forms of embodiments. In addition, any suitable size, shape or type of elements or materials could be used.

The assembly 10 generally comprises a first electrical connector 12 and a mated second electrical connector 14. The first electrical connector 12 comprises a housing 16 and electrical contacts or terminals 18. The second electrical connector 14 comprises a housing 20 and electrical contacts or terminals 22.

Figure 2:
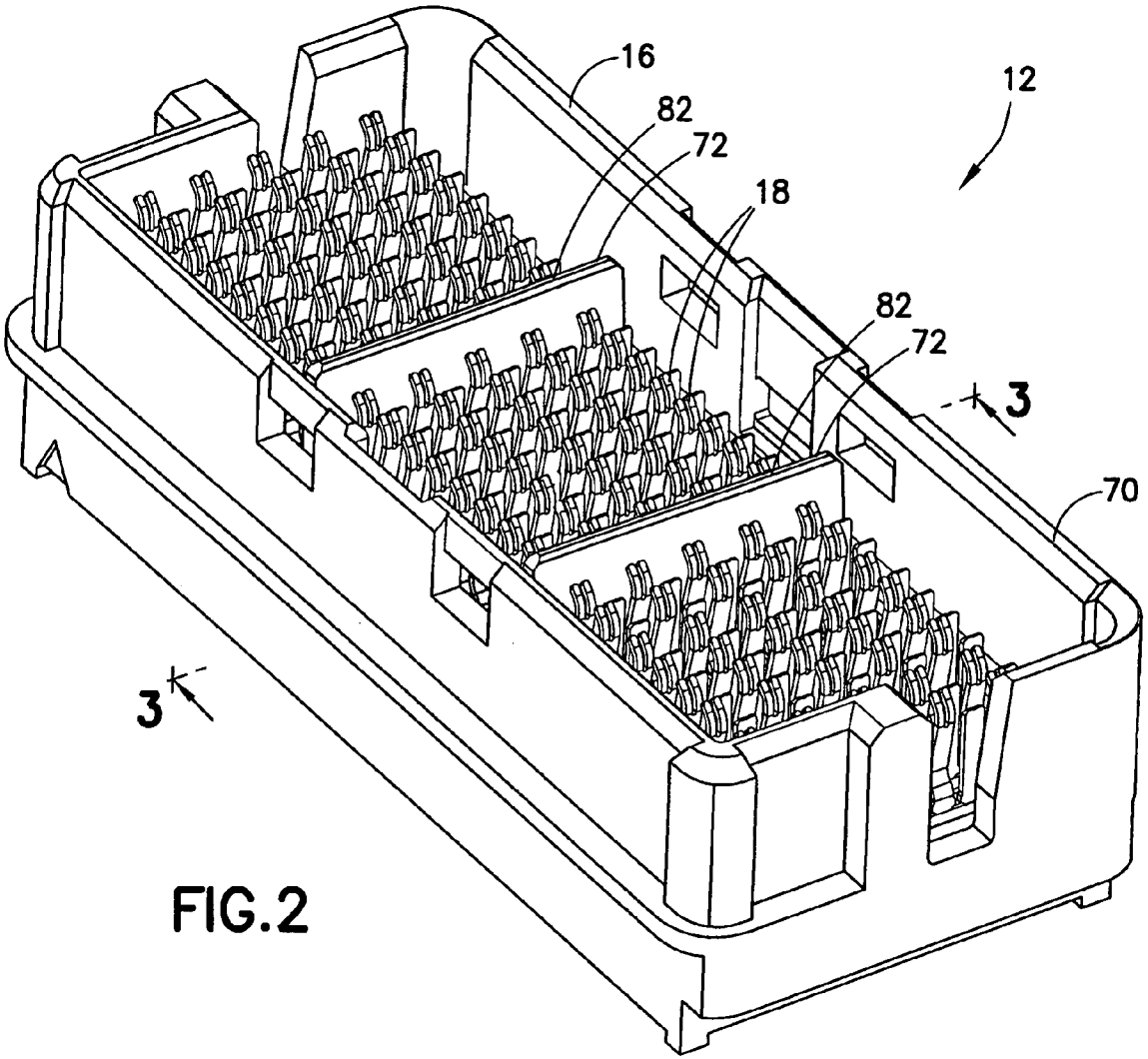
FIG. 2 is a perspective view of one of the electrical connectors shown in FIG. 1.
Figure 3:
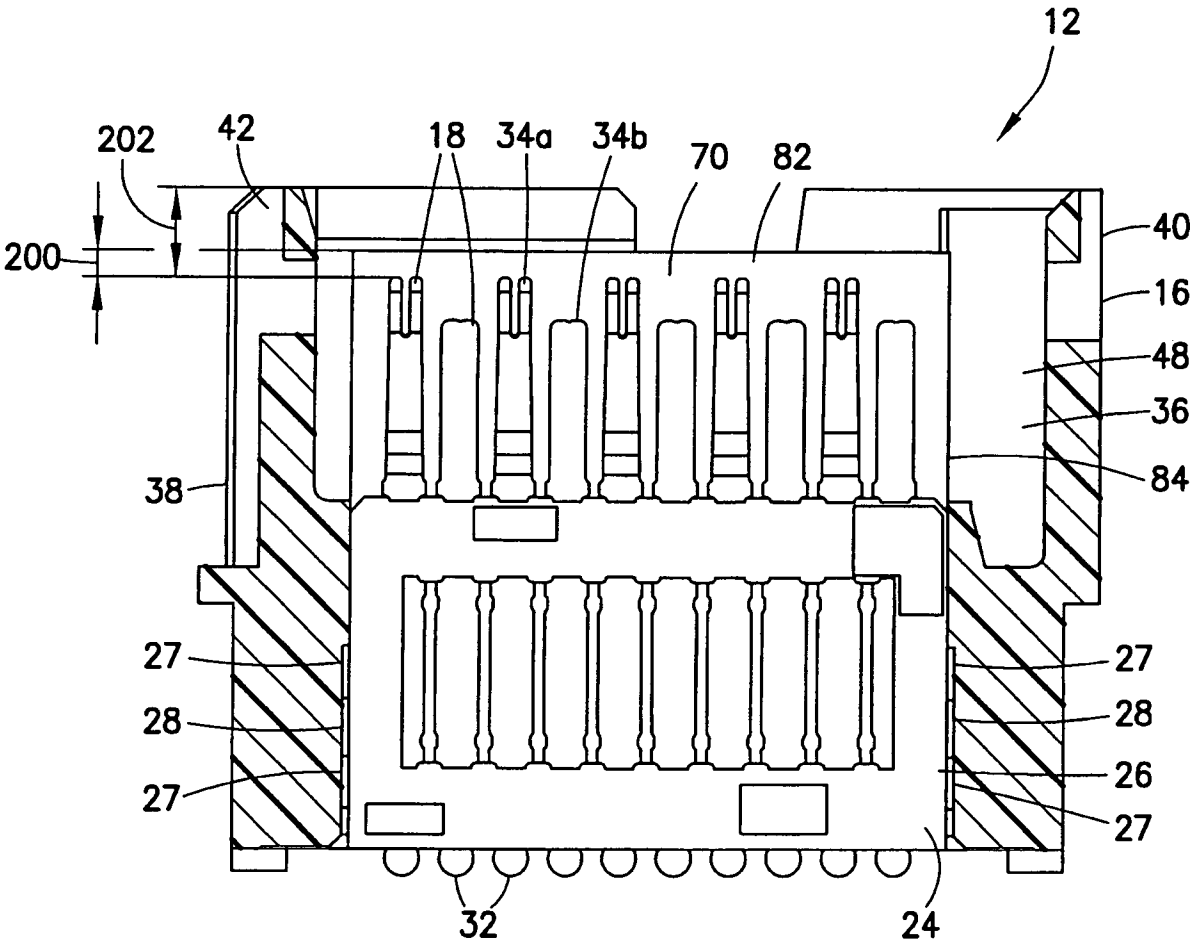
FIG. 3 is a cross sectional view taken along line 3-3 in FIG. 2.
Figure 4:
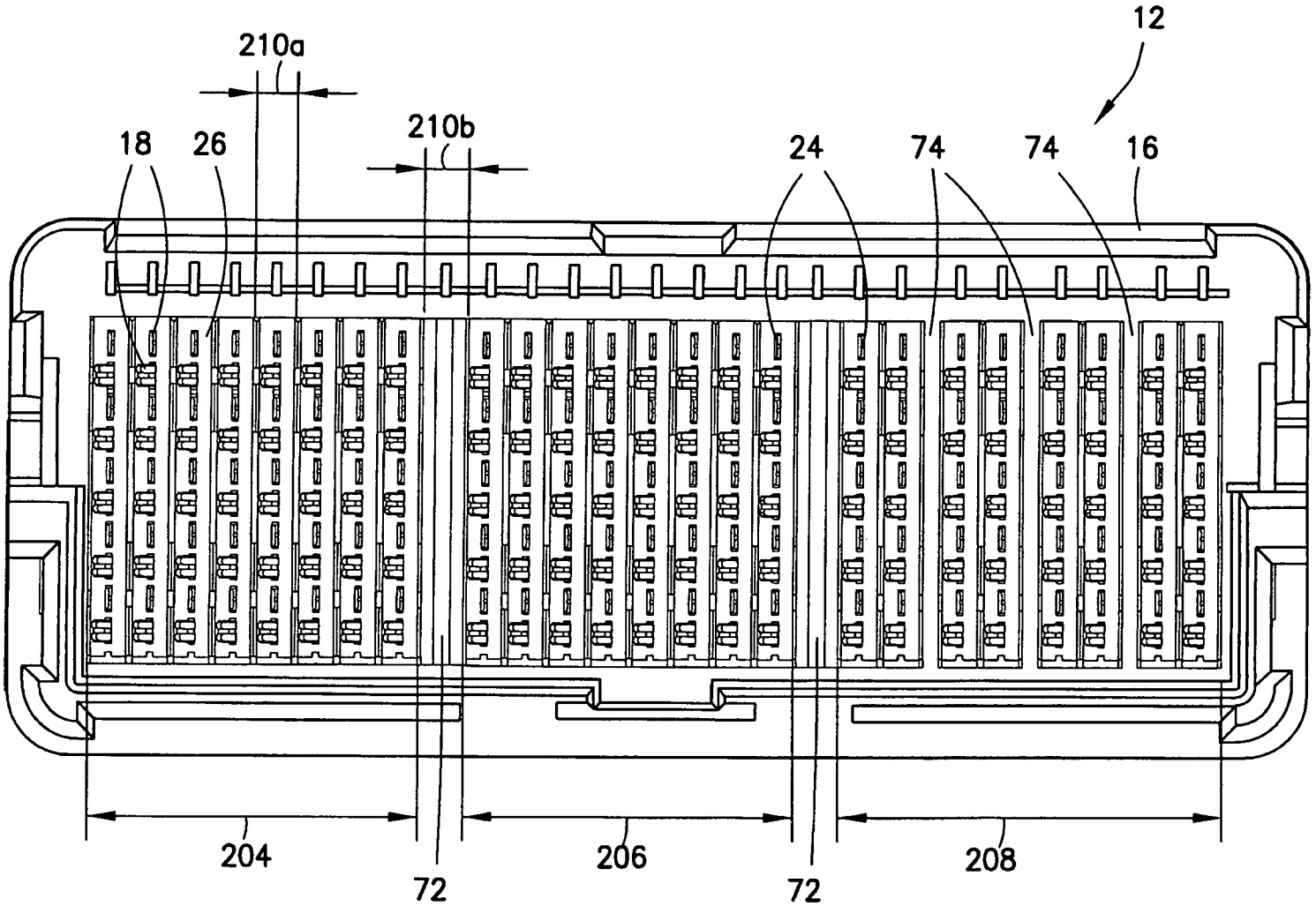
FIG. 4 is a top side view of the connector shown in FIG. 2.

Referring also to FIGS. 2-4, in this example embodiment the contacts 18 of the first connector 12 are provided in multiple wafers as Insert Molded Leadframe Assemblies (IMLAs) 24. Examples of IMLAs are described in U.S. Pat. No. 6,869,292 B2 and U.S. patent publication No. 2010/0055988 A1 which are hereby incorporated by reference in their entireties. However, in alternate embodiments, the first connector 12 might not use IMLAs. The IMLAs in this example embodiment comprise a plurality of the contacts 18 aligned in a row and a plastic overmolded frame 26. The frame 26 keeps the row of contacts 18 together for easy assembly into the housing 16. The contacts 18, in this example, comprise two different types of contacts with different mating contact ends 34*a*, 34*b*. However, any suitable type of mating contact ends could be provided, or any number of different contacts could be provided including just one type or more than two types. In this example embodiment the IMLAs also comprise fusible elements 32. The fusible elements 32 are connected to ends of the contacts 18 for electrically and mechanically connecting the connector 16 to another component, such as a printed circuit board for example.

Figure 5:
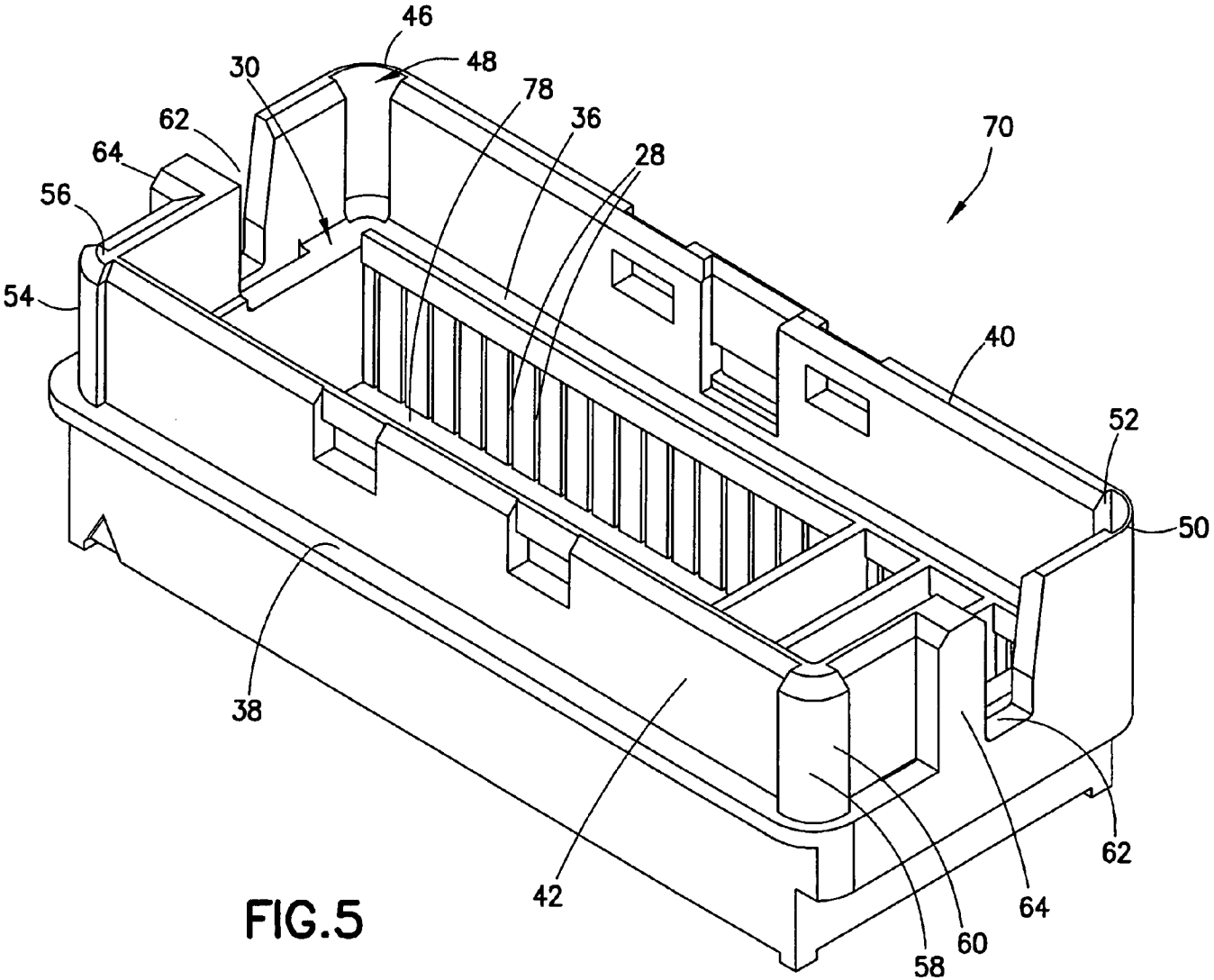
FIG. 5 is a perspective view of a main housing member of the connector shown in FIG. 2.
Figure 7:
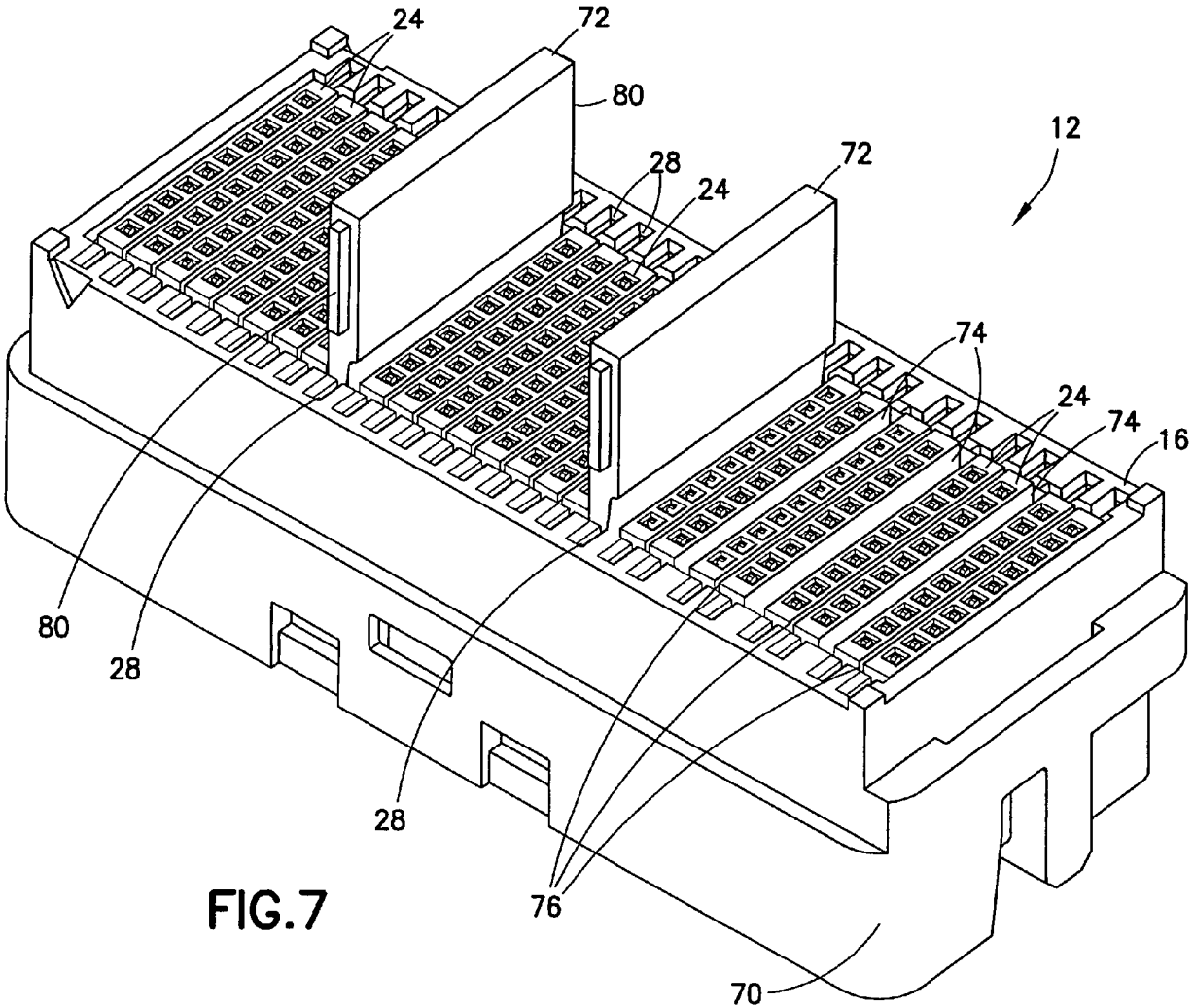
FIG. 7 is a perspective view showing a bottom side of the connector shown in FIG. 2 showing installation of the protective wafers into the connector.

Referring also to FIGS. 5 and 7, in this example the housing 16 comprises a main housing member 70 and two protective wafers 72. However, more or less than two protective wafers could be provided. The housing comprises a contact locating area 30. The contact locating area 30 is configured to have the IMLAs 24 and the protective wafers 72 mounted therein. In this example embodiment opposite sides of the locating area 30 comprise slots 28 for receiving lateral end portions 27 of the frames 26 to thereby mount the IMLAs to the housing 16. However, any suitable mounting system could be provided. In this example the contact locating area 30 comprises different sections. The main housing member 70 has three spacer ribs 74 which form three sections 76; each section 76 being sized and shaped to receive two of the IMLAs 24. The remaining portion 78 of the locating area 30 receives the two protective wafers 72 and the rest of the IMLAs 24.

As illustrated in FIG. 7, the protective wafers 72 are inserted into the area 30 through the bottom of the main housing area. Each wafer 72 has opposite end portions 80 adapted to be matingly slid into a pair of the slots 28. Once the wafers 24, 72 are inserted into the slots 28, they may be permanently connected to the main housing member 70, such as by ultrasonic welting for example. The protective wafers 72 are comprised of plastic or polymer material and do not comprise electrical contacts. The slots 28 only extend partially along the height of the area 30. Thus, both the IMLA wafers 24 and the protective wafers 72 are stopped at a predetermined depth of insertion into the slots. The protective wafers 72 have a same thickness as the IMLA wafers 24. Thus, the number of wafers 24, 72 and location of the wafers 24, 72 relative to each other can be varied. The wafers 24, 72 are interchangeably locatable in any pair of the opposing slots 28. The protective wafers 72 could be removed completely and two additional IMLA wafers could be used in their place for example.

As seen best in FIGS. 2 and 3, when the protective wafers 72 are installed, top sides 82 of the protective wafers 72 extend above the top ends 34*a*, 34*b* of the contacts 18. In this example embodiment a height 200 is provided between the top ends 34*a* and the top sides 82, such as about 0.45 mm for example. The height 202 is about 1.65 mm for example. As seen in FIG. 4, the widths 204, 206, 208 of the stacked IMLA wafers can be, for example, 10.9 mm, 10.6 mm, and 12.4 mm. However, these dimensions are merely an example of one embodiment.

Because the top sides 82 of the protective wafers 72 project above top ends of the contacts located in the contact locating area, the protective wafers 72 and the main housing member 70 combine to help prevent a user's finger from contacting the top ends 34*a*, 34*b* of the contacts 18 located in the contact locating area. This is particularly insightful because, with connector miniaturization, as the size of the top ends of contacts have gotten smaller and more contacts are being located together, the very small contact ends could be prone to damage before mating if an object, such as a user's finger, were to go into the area 30. As seen from FIG. 2, if the top sides 82 did not extend above the top ends of the contacts, it would be easier for a user's finger or other object to contact and damage the top ends of the contacts. With the top sides 82 located above the top ends of the contacts, there is less risk of damage to the top ends 34*a*, 34*b* of the contacts.

The main housing member 70 is comprised of molded plastic or polymer material. In addition to the contact locating area 30, the housing 16 comprises a mating connector area configured to receive portions of the housing 20 of the second connector 14. In this example embodiment the mating connector area comprises two areas 36, 38. However, more than two areas could be provided. The mating connector area comprises a first wall 40 forming the first area 36 adjacent the contact locating area 30, and a second wall 42 adjacent the contact locating area 30 forming the second area 38. The second area 38 is separated from the contact locating area 30 by the second wall 42. The first area 36 and the second wall 42 have a substantially same size and shape.

The first area 36 comprises a general elongated "U" shape in this example embodiment. The first area 36 comprises a first corner 46 having an outwardly extending recess 48, and a second corner 50 having an outwardly extending recess 52. The second wall 42 comprises a first corner 54 having a first outwardly extending projection 56 into the second area 38, and a second corner 58 with a second outwardly extending projection 60. The recesses 48, 52 have a general quarter circle shape, and the projections 56, 60 have a general quarter circle shape. The second area 38 is essentially an inverse of the first wall 40. Likewise, the second wall 42 is essentially an inverse of the first area 36. In this example embodiment the two walls 40, 42 are separated by two slots 62 at opposite ends of the housing. The second wall 42 has two projections 64 at opposite ends of the housing.

Figure 6:
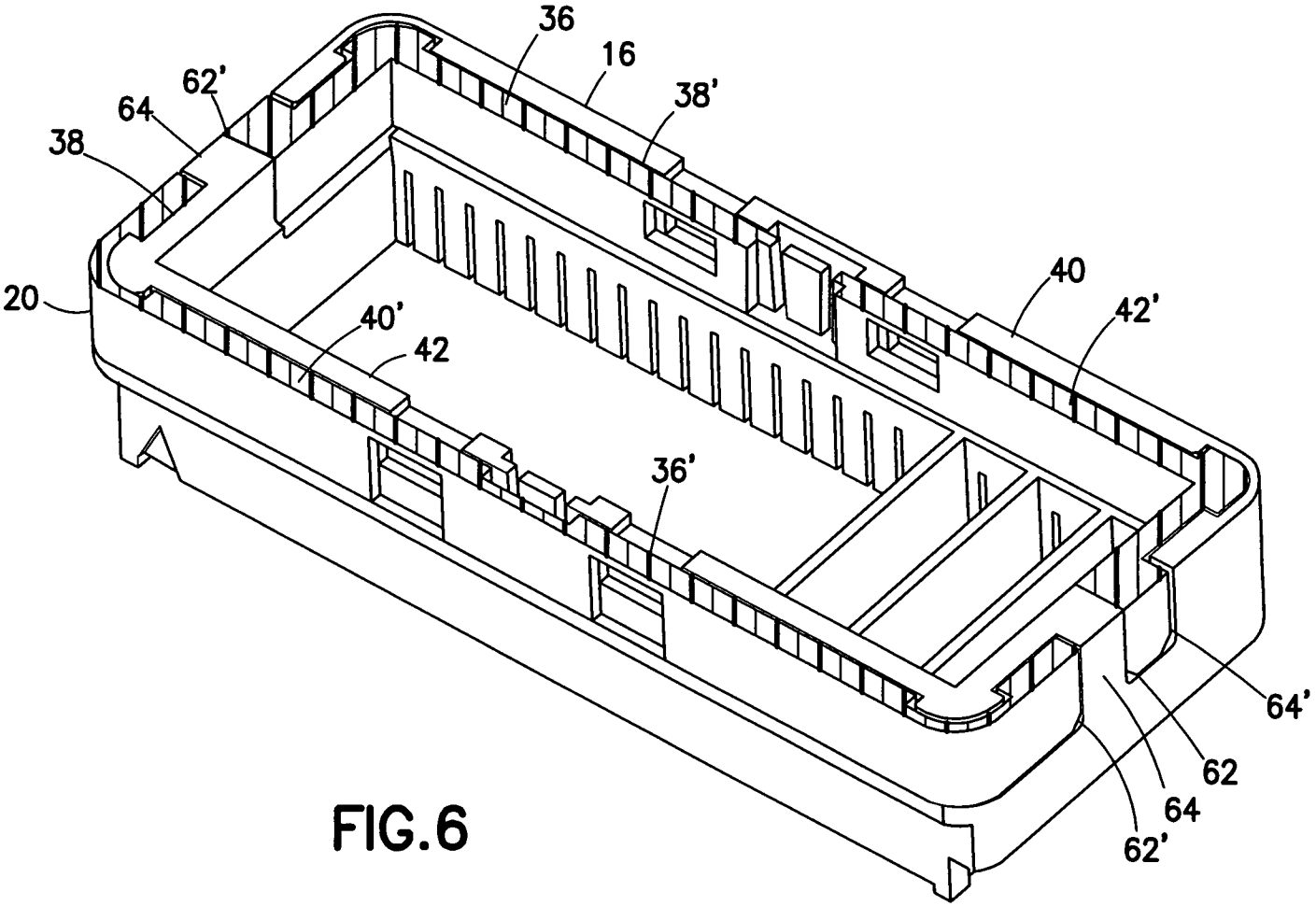
FIG. 6 is a perspective view of the housing as shown in FIG. 5 with a cut away section of the housing of the mating electrical connector shown attached thereto.

Referring also to FIG. 6, the first housing 16 is shown with a cut-away section of the second housing 20 of the mating connector 14. The second housing 20 has a mating connector area configured to receive portions of the housing 16 of the first connector 12. The mating connector area of the second housing 20 comprises a first wall 40' forming the first area 36' adjacent its contact locating area, and a second wall 42' adjacent its contact locating area forming a second area 38'. The second area 38' is separated from the contact locating area of the second connector housing by the second wall 42'.

The two first walls 40, 40' have a same size and shape. The two second walls 42, 42' have a same size and shape. The two first areas 36, 36' have a same size and shape. The two second areas 38, 38' have a same size and shape. However, the two mating connector areas are flipped relative to each other in order to be mated. Thus, when mated the first wall 40 is located in the. second area 38'. The first wall 40' is located in the second area 38. The second wall 42 is located in the first area 36'. The second wall 42' is located in the first area 36. The projections 64 are received in the slots 62', and the projections 64' are located in the slots 62. The mating connector area 30 of the first connector is hermaphroditic; having matingly shaped male and female sections. Likewise, the mating connector area of the second connector is hermaphroditic; having matingly shaped male and female sections. The two hermaphroditic mating connection areas mate with each other.

As seen best in FIG. 3, the lateral edge 84 of the protective wafer 72 is spaced from the wall 40 so as not to interfere with the area 36. As best seen in FIG. 1, the top sides 82 of the protective wafers 72 have a general wedge shape. The mating second connector 14 has a similar set of IMLA wafers 24' and protective waters 72'. When the contacts of the IMLA wafers 24, 24' mate with each other, the general wedge shapes of top ends 82, 82' of the pairs of the protective wafers 72, 72' are able to mate adjacent to each other. Thus, the opposing protective wafers 72, 72', even though they extend above the top ends of the contacts 18, 22, do not interfere with the two connectors 12, 14 mating with each other.

Figure 8:
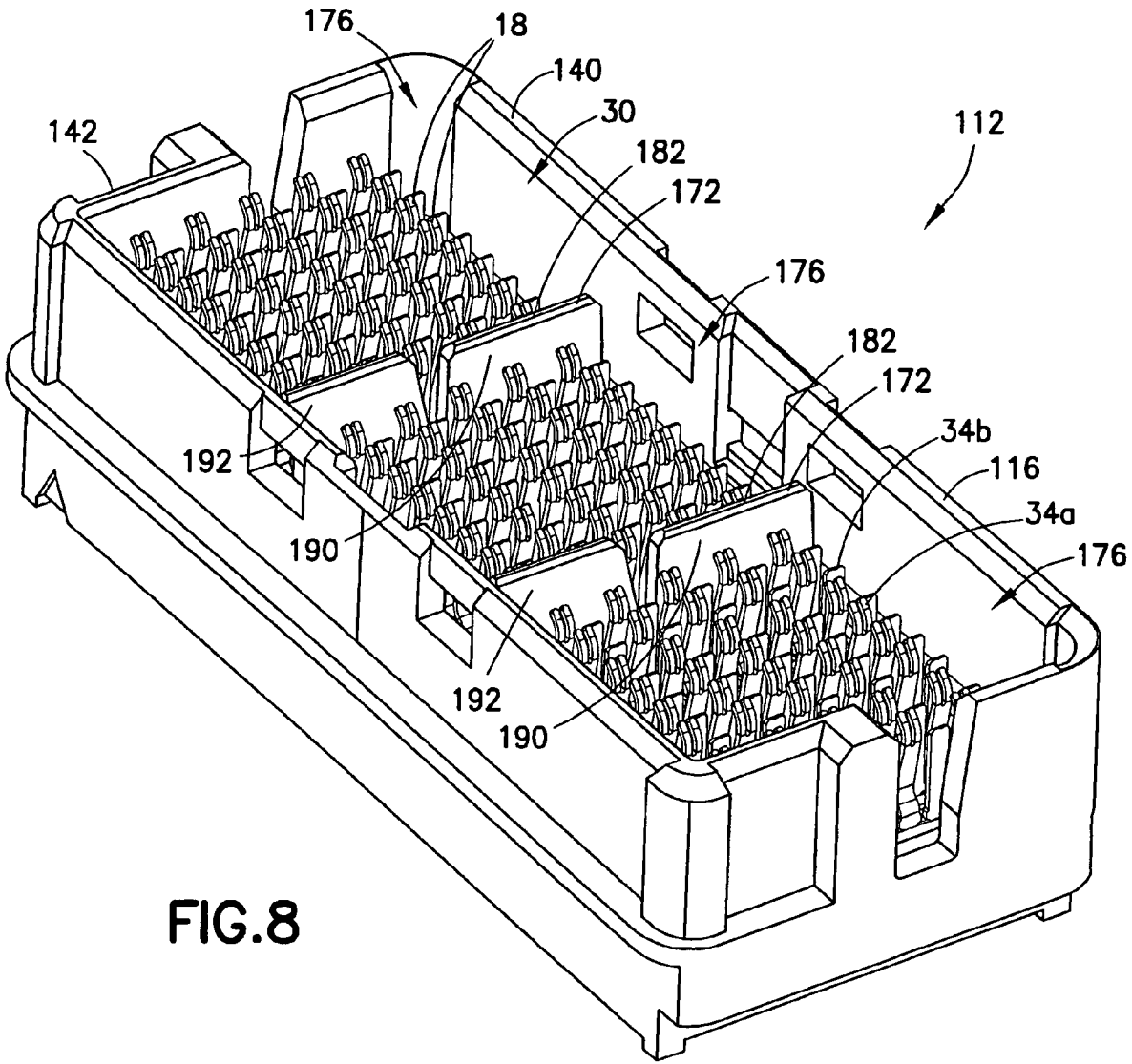
FIG. 8 is a perspective view similar to FIG. 2 of an alternate embodiment of the invention.
Figure 9:
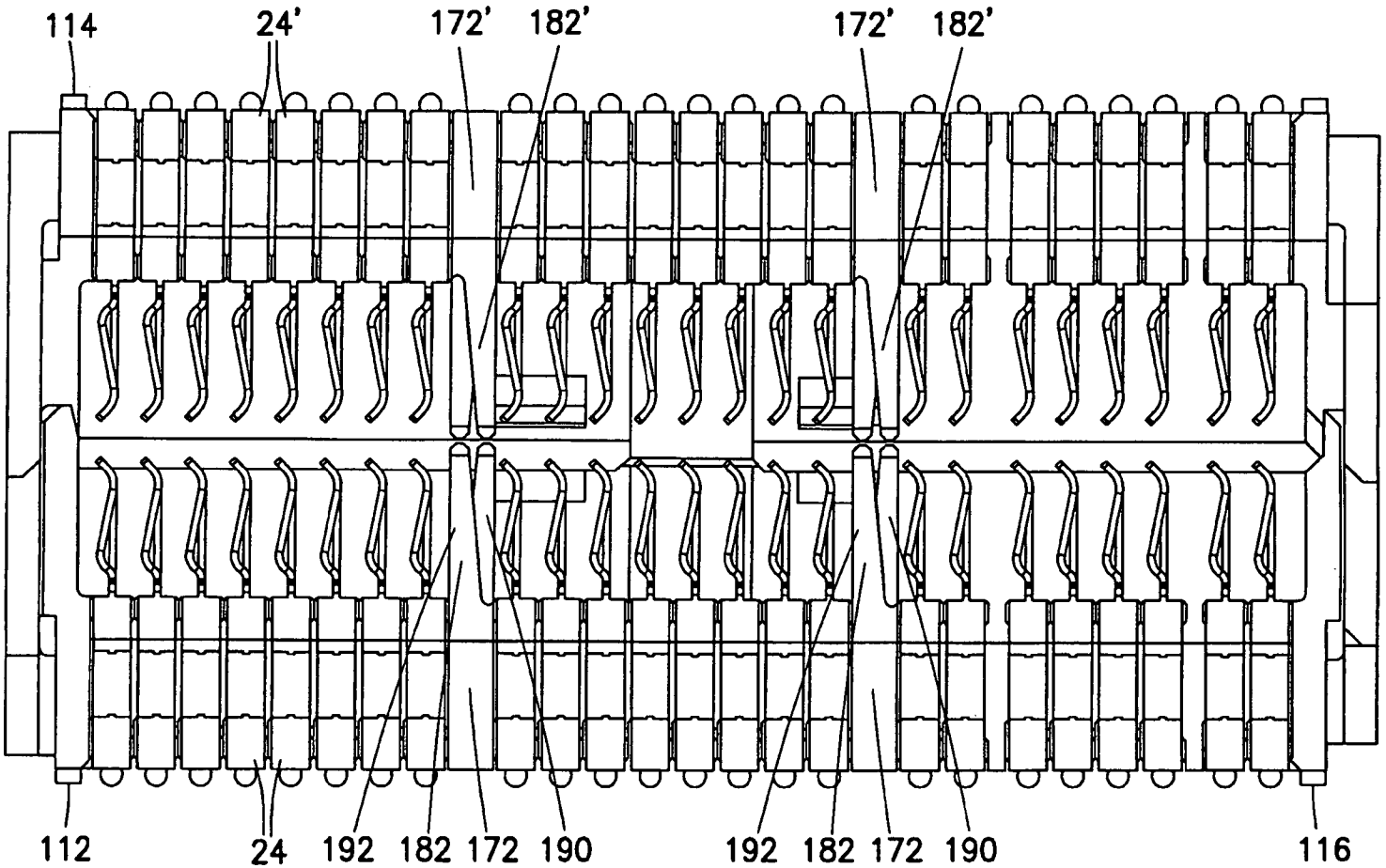
FIG. 9 is a cross sectional view showing the connector of FIG. 8 being connected with a mating second electrical connector.
Figure 10:
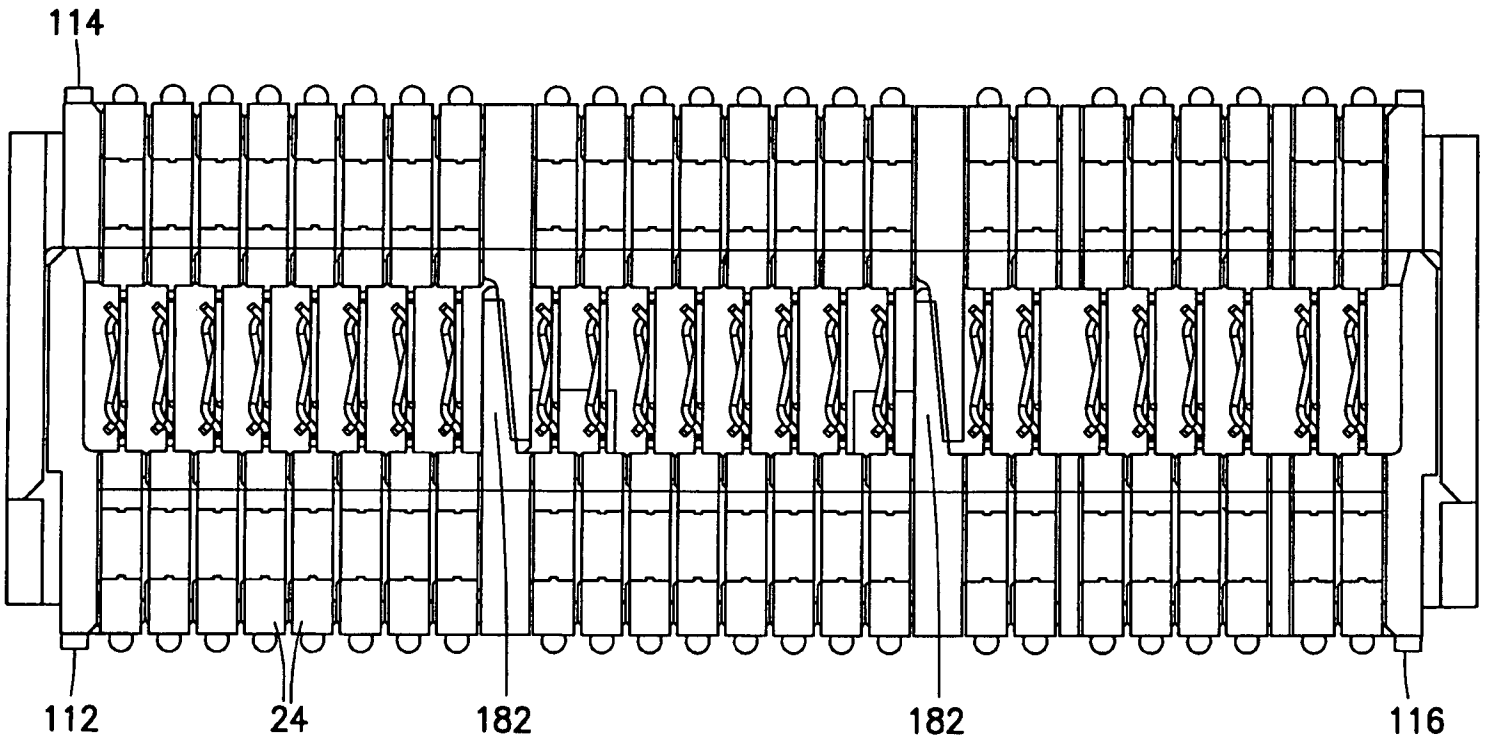
FIG. 10 is a cross sectional view similar to FIG. 9 showing the electrical connectors fully mated.

Referring also to FIGS. 8-10 an alternate example embodiment is shown. The electrical connector 112 in this embodiment comprises a housing 116 and electrical contacts or terminals 18. The contacts 18 are provided in multiple wafers of Insert Molded Leadframe Assemblies (IMLAs) 24. In this example the housing 116 comprises a single member. The housing comprises a contact locating area 30. The contact locating area 30 has the IMLAs mounted therein. In this example embodiment opposite sides of the locating area 30 comprise slots (such as 28 shown in FIG. 5) for receiving lateral end portions 27 of the frames 26 (see FIG. 3) to thereby mount the IMLAs to the housing 116. The housing 116 has two integrally formed protective wafers 172 which form three sections 176 of the IMLA wafers 24.

In this example embodiment, similar to the first example, the top sides 182 of the protective wafers 172 extend above the top ends 34*a*, 34*b* of the contacts 18. Because the top sides 182 of the protective wafers 172 project above top ends of the contacts located in the contact locating area, the protective wafers and the top outer walls 140, 142 forming the raised perimeter around the contact locating area combine to help prevent a user's finger from contacting the top ends 34*a*, 34*b* of the contacts 18 located in the contact locating area. This is particularly insightful because, with connector miniaturization, as the size of the top ends of contacts have gotten smaller and more contacts are being located together, the very small contact ends could be prone to damage before mating if an object, such as a user's finger, were to go into the area 30. As seen from FIG. 8, if the top sides 182 did not extend above the top ends of the contacts, it would be easier for a user's finger or other object to contact and damage the top ends of the contacts. With the top sides 182 located above the top ends of the contacts, there is less risk of damage to the top ends of the contacts.

The top side 182 of each protective wafer 172 comprise two general wedge shapes 190, 192 extending upward at different angles. The mating second electrical connector 114 has a similar set of IMLA wafers 24' and integrally formed protective wafers 172'. When the contacts of the IMLA wafers 24, 24' mate with each other, the general wedge shapes of top ends 182, 182' of the pairs of the protective wafers 172, 172' are able to mate adjacent to each other. Thus, the opposing protective wafers 172, 172', even though they extend above the top ends of the contacts 18, 22, do not interfere with the two connectors 112, 114 mating with each other. In one type of alternate embodiment the multiple wedge shaped top side (190, 192) of the wafers could be provided on the separately installed wafer 72.

In one type of example, an electrical connector housing may be provided comprising a main housing member having a contact locating area, where opposite sides of the contact locating area comprise slots for receiving opposite end portions of insertable wafers; and at least one protective wafer configured to be located in the contact locating area, where the protective wafer comprises opposite end portions adapted to be matingly slid into a pair of the slots, where the protective wafer has a top side configured to project above top ends of contacts located in the contact locating area where the protective wafer and the main housing member are sized and shaped to combine to help prevent a user's finger, or other relatively large object, from contacting the top ends of the contacts located in the contact locating area.

The slots may extend into a bottom of the main housing member only partially up the opposite sides. The main housing member may be configured to receive multiple side-by-side Insert Molded Leadframe Assemblies (IMLAs) as some of the insertable wafers, and a spacing between adjacent slots on the opposite sides may be uniform in at least one section of the contact locating area which is configured to receive the at least one protective wafer and at least some of the IMLAs. The at least one protective wafer may comprise a polymer frame without an electrical contact. The top side of the protective wafer may comprise a general wedge shape. The top side of the protective wafer may comprise at least two general wedge shapes extending upward at different angles. An electrical connector may be provided comprising the housing as described above; and a plurality of Insert Molded Leadframe Assemblies (IMLAs) mounted to the main housing member, where the at least one protective wafer is connected to the main housing member sandwiched between two groups of the IMLAs. The top side of the protective wafer comprises a general wedge shape. An electrical connector assembly may be provided comprising the electrical connector as described above forming a first electrical connector; and a second electrical connector connected to the first electrical connector, where the second electrical connector comprises a second main housing member having a second contact locating area; a plurality of second Insert Molded Leadframe Assemblies (IMLAs) mounted to the second main housing member; and at least one second protective wafer located in the second contact locating area, where the second protective wafer comprises a top side configured to project above top ends of contacts of the second IMLAs, where the top side of the second protective wafer comprises a general wedge shape which mates adjacent with the top side of the protective wafer of the first electrical connector.

An electrical connector may be provided comprising a plurality of Insert Molded Leadframe Assemblies (IMLAs); and a housing having the IMLAs connected thereto, where the housing comprises a main housing member and at least one protective wafer connected to the main housing member. The main housing member may comprise a contact locating area having IMLA mounting slots on opposite sides of the contact locating area. The IMLAs may each have opposite ends located in pairs of the IMLA mounting slots. The protective wafer may comprise opposite end portions matingly slid into a pair of the slots. The protective wafer may have a top side projecting above top ends of contacts of the IMLAs, and the top side and the main housing may be sized and shaped to combine to help prevent a user's finger from contacting the top ends of the contacts.

The slots may extend into a bottom of the main housing member only partially up the opposite sides. The IMLAs may comprise electrical contacts and an overmolded frame, where a thickness of the protective wafer is a same thickness as the frame. The top side of the protective wafer may comprise at least two general wedge shapes extending upward at different angles. The top side of the protective wafer may comprise a general wedge shape. An electrical connector assembly may be provided comprising an electrical connector as described above forming a first electrical connector; and a second electrical connector connected to the first electrical connector, where the second electrical connector comprises a second main housing member having a second contact locating area; a plurality of second Insert Molded Leadframe Assemblies (IMLAs) mounted to the second main housing member; and at least one second protective wafer located in the second contact locating area, where the second protective wafer comprises a top side configured to project above top ends of contacts of the second IMLAs, where the top side of the second protective wafer comprises a general wedge shape which mates adjacent with the top side of the protective wafer of the first electrical connector.

A method may be provided comprising providing a main housing member, where the main housing member comprises a contact locating area having IMLA mounting slots on opposite sides of the contact locating area; and inserting at least one protective wafer into the main housing member, where the protective wafer comprises opposite end portions matingly slid into a pair of the IMLA mounting slots, where the protective wafer has a top side adapted to project above top ends of contacts located in the contact locating area, where the top side is sized and shaped to combine with the main housing to help prevent a user's finger from contacting the top ends of the contacts located in the contact locating area.

The method may further comprise inserting a plurality of Insert Molded Leadframe Assemblies (IMLAs) into the contact locating area adjacent opposite sides of the protective wafer. The method may further comprise providing the IMLA mounting slots with a uniform spacing between adjacent slots on the opposite sides in at least one section of the contact locating area, where the IMLAs and the protective wafer are provided with a substantially same thickness to be located against each other in the section of the contact locating area. Inserting the protective wafer may comprise providing the top side of the protective wafer with at least two general wedge shapes extending upward at different angles. Inserting the protective wafer may comprise providing the top side of the protective wafer with a general wedge shape.

An example embodiment may provide an electrical connector comprising a plurality of Insert Molded Leadframe Assemblies (IMLAs); and a housing having the IMLAs connected thereto, where the housing comprises a contact locating area having IMLA mounting slots on opposite sides of the contact locating area, where the IMLAs each have opposite ends located in pairs of the IMLA mounting slots, where the housing comprises at least one top outer wall forming a raised perimeter around the contact locating area and at least one interior wall between opposite sections of the raised perimeter forming spaced sections of the IMLAs, where the at least one interior wall has a top side projecting above top ends of contacts of the IMLAs, where the top side of the interior wall comprises a general wedge shape, and where the top side and the raised perimeter are sized and shaped to combine to help prevent a user's finger from contacting the top ends of the contacts.

The example embodiments described above are for a hermaphroditic connector; having both male and female sections mateable with similarly shaped female and male sections of the mating connector. However, features of the invention could be used in a connector which is not hermaphroditic. In one type of embodiment the protective wafers 72 could be removed and replaced with IMLA wafers if the protection feature of the wafers 72 is considered unnecessary for some applications or connection environments. Thus, features described herein allow the electrical connector to be selectably configurable regarding where a protective wafer 72 may be located, and how many protective wafers 72 may be used. The wafers 24, 72 use the same slots 28 and have widths 210*a*, 210*b* (see FIG. 4) which are the same.

Although features have been described above with reference to an example comprising IMLAs, features could also be used in a connector which does not have IMLAs, such as connector having stitched contacts into a housing. In another example embodiment one or more of the protective wafer(s) could be integrally molded into the housing. In another example embodiment, the protective wafer(s) do not have to be the same thickness as a standard IMLA. One or more of the protective wafer(s) could be larger or smaller in thickness.

It should be understood that the foregoing description is only illustrative. Various alternatives and modifications can be devised by those skilled in the art. For example, features recited in the various dependent claims could be combined with each other in any suitable combination(s). In addition, features from different embodiments described above could be selectively combined into a new embodiment. Accordingly, the description is intended to embrace all such alternatives, modifications and variances which fall within the scope of the appended claims.

What is claimed is:

1. An electrical connector housing comprising:

a main housing member having a contact locating area, where opposite sides of the contact locating area comprise slots for receiving opposite end portions of insertable wafers; and at least one protective wafer configured to be located in the contact locating area, where the protective wafer comprises opposite end portions adapted to be matingly slid into a pair of the slots, where the protective wafer has a top side configured to project above top ends of contacts located in the contact locating area where the protective wafer and the main housing member are sized and shaped to combine to help prevent a user's finger from contacting the top ends of the contacts located in the contact locating area.

2. An electrical connector housing as in claim 1 where the slots extend into a bottom of the main housing member only partially up the opposite sides.

3. An electrical connector housing as in claim 1 where the main housing member is configured to receive multiple side-by-side Insert Molded Leadframe Assemblies (IMLAs) as some of the insertable wafers, and where a spacing between adjacent slots on the opposite sides is uniform in at least one section of the contact locating area which is configured to receive the at least one protective wafer and at least some of the IMLAs.

4. An electrical connector housing as in claim 1 where the at least one protective wafer comprises a polymer frame without an electrical contact.

5. An electrical connector housing as in claim 1 where the top side of the protective wafer comprises a general wedge shape.

6. An electrical connector housing as in claim 1 where the top side of the protective wafer comprises at least two general wedge shapes extending upward at different angles.

7. An electrical connector comprising:

a housing as in claim 1; and a plurality of Insert Molded Leadframe Assemblies (IMLAs) mounted to the main housing member, where the at least one protective wafer is connected to the main housing member sandwiched between two groups of the IMLAs.

8. An electrical connector as in claim 7 where the top side of the protective wafer comprises a general wedge shape.

9. An electrical connector assembly comprising:

an electrical connector as in claim 8 forming a first electrical connector; and a second electrical connector connected to the first electrical connector, where the second electrical connector comprises:

a second main housing member having a second contact locating area;

a plurality of second Insert Molded Leadframe Assemblies (IMLAs) mounted to the second main housing member; and at least one second protective wafer located in the second contact locating area, where the second protective wafer comprises a top side configured to project above top ends of contacts of the second IMLAs, where the top side of the second protective wafer comprises a general wedge shape which mates adjacent with the top side of the protective wafer of the first electrical connector.

10. An electrical connector comprising:

a plurality Insert Molded Leadframe Assemblies (IMLAs); and a housing having the IMLAs connected thereto, where the housing comprises a main housing member and at least one protective wafer connected to the main housing member, where the main housing member comprises a contact locating area having IMLA mounting slots on opposite sides of the contact locating area, where the IMLAs each have opposite ends located in pairs of the IMLA mounting slots, where the protective wafer comprises opposite end portions matingly slid into a pair of the slots, where the protective wafer has a top side projecting above top ends of contacts of the IMLAs, and where the top side and the main housing are sized and shaped to combine to help prevent a user's finger from contacting the top ends of the contacts.

11. An electrical connector as in claim 10 where the slots extend into a bottom of the main housing member only partially up the opposite sides.

12. An electrical connector as in claim 10 where the IMLAs comprise electrical contacts and an overmolded frame, where a thickness of the protective wafer is a same thickness as the frame.

13. An electrical connector as in claim 10 where the top side of the protective wafer comprises at least two general wedge shapes extending upward at different angles.

14. An electrical connector as in claim 10 where the top side of the protective wafer comprises a general wedge shape.

15. An electrical connector assembly comprising:

an electrical connector as in claim 14 forming a first electrical connector; and a second electrical connector connected to the first electrical connector, where the second electrical connector comprises:

a second main housing member having a second contact locating area;

a plurality of second Insert Molded Leadframe Assemblies (IMLAs) mounted to the second main housing member; and at least one second protective wafer located in the second contact locating area, where the second protective wafer comprises a top side configured to project above top ends of contacts of the second IMLAs, where the top side of the second protective wafer comprises a general wedge shape which mates adjacent with the top side of the protective wafer of the first electrical-connector.

16. A method comprising:

providing a main housing member, where the main. housing member comprises a contact locating area having IMLA mounting slots on opposite sides of the contact locating area; and inserting at least one protective wafer into the main housing member, where the protective wafer comprises opposite end portions matingly slid into a pair of the IMLA mounting slots, where the protective wafer has a top side adapted to project above top ends of contacts located in the contact locating area, where the top side is sized and shaped to combine with the main housing to help prevent a user's finger from contacting the top ends of the contacts located in the contact locating area.

17. A method as in claim 16 further comprising inserting a plurality of Insert Molded Leadframe Assemblies (IMLAs) into the contact locating area adjacent opposite sides of the protective wafer.

18. A method as in claim 17 further comprising providing the IMLA mounting slots with a uniform spacing between adjacent slots on the opposite sides in at least one section of the contact locating area, where the IMLAs and the protective wafer are provided with a substantially same thickness to be located against each other in the section of the contact locating area.

19. A method as in claim 16 wherein inserting the protective wafer comprises providing the top side of the protective wafer with at least two general wedge shapes extending upward at different angles.

20. A method as in claim 16 wherein inserting the protective wafer comprises providing the top side of the protective wafer with a general wedge shape.

21. An electrical connector comprising:

a plurality of Insert Molded Leadframe Assemblies (IMLAs); and a housing having the IMLAs connected thereto, where the housing comprises a contact locating area having IMLA mounting slots on opposite sides of the contact locating area, where the IMLAs each have opposite ends located in pairs of the IMLA mounting slots, where the housing comprises at least one top outer wall forming a raised perimeter around the contact locating area and at least one interior wall between opposite sections of the raised perimeter forming spaced sections of the IMLAs, where the at least one interior wall has a top side projecting above top ends of contacts of the IMLAs, where the top side of the interior wall comprises a general wedge shape, and where the top side and the raised perimeter are sized and shaped to combine to help prevent a user's finger from contacting the top ends of the contacts, where the general wedge shape tapers in an upward direction.

* * * * *

UNITED STATES PATENT AND TRADEMARK OFFICE

CERTIFICATE OF CORRECTION

PATENT NO. : 8,827,741 B2
APPLICATION NO. : 13/437360
DATED : September 9, 2014
INVENTOR(S) : Johnson et al.

It is certified that error appears in the above-identified patent and that said Letters Patent is hereby corrected as shown below:

In the Claims

Claim 10, col. 9, line 23 --of-- should be inserted in between “plurality” and “Insert”.

Signed and Sealed this
Eleventh Day of November, 2014

Michelle K. Lee

Michelle K. Lee
*Deputy Director of the United States Patent and Trademark Office*